US011638513B2

(12) United States Patent
Mohite et al.

(10) Patent No.: US 11,638,513 B2
(45) **Date of Patent: *May 2, 2023**

(54) DISHWASHER WITH MOVEABLE SHELF

(71) Applicant: Whirlpool Corporation, Benton Harbor, MI (US)

(72) Inventors: Vikramsinh S. Mohite, Pune (IN); Shailender Tiwari, Haryana (IN)

(73) Assignee: Whirlpool Corporation, Benton Harbor, MI (US)

( * ) Notice: Subject to any disclaimer, the term of this patent is extended or adjusted under 35 U.S.C. 154(b) by 94 days.

This patent is subject to a terminal disclaimer.

(21) Appl. No.: 17/155,568

(22) Filed: Jan. 22, 2021

(65) Prior Publication Data

US 2021/0137347 A1 May 13, 2021

Related U.S. Application Data

(63) Continuation of application No. 15/928,792, filed on Mar. 22, 2018, now Pat. No. 10,945,585.

(51) Int. Cl.
*A47L 15/50* (2006.01)

(52) U.S. Cl.
CPC ..... *A47L 15/503* (2013.01); *A47L 15/505* (2013.01)

(58) Field of Classification Search
CPC ..... A47L 15/50; A47L 15/503; A47L 15/505
See application file for complete search history.

(56) References Cited

U.S. PATENT DOCUMENTS

| | | | |
|---|---|---|---|
| 8,701,898 | B2 | 4/2014 | Chai |
| 2005/0242046 | A1 | 11/2005 | Lee |
| 2008/0110480 | A1 | 5/2008 | Choi et al. |

FOREIGN PATENT DOCUMENTS

| | | | |
|---|---|---|---|
| CN | 201061516 | Y | 5/2008 |
| CN | 201223368 | Y | 4/2009 |
| EP | 1282376 | A1 | 2/2003 |
| EP | 1925251 | A2 | 5/2008 |
| EP | 2074925 | A1 | 7/2009 |
| KR | 2010003746 | A | 4/2010 |
| KR | 20100037460 | A | 4/2010 |
| WO | 0187133 | A1 | 11/2001 |

OTHER PUBLICATIONS

European Patent Office, European Search Report re Application No. 19162587.0-1018, Sep. 9, 2019, 8 pages, Munich, Germany.

*Primary Examiner* — David G Cormier
(74) *Attorney, Agent, or Firm* — McGarry Bair PC

(57) ABSTRACT

A dishwasher having a tub at least partially defining a treating chamber that receives dishes for treatment, a dish rack located in the tub and having a bottom wall and at least a side wall extending upwardly from the bottom wall, the side wall including a set of vertical tines and a shelf having a planar body extending along a length and operably coupled to the set of vertical tines and rotatable between a stowed position that is substantially vertical and a deployed position that is substantially horizontal.

18 Claims, 6 Drawing Sheets

DISHWASHER WITH MOVEABLE SHELF

CROSS-REFERENCE TO RELATED APPLICATIONS

This application is a continuation of U.S. patent application Ser. No. 15/928,792, filed Mar. 22, 2018, now U.S. Pat. No. 10,945,585, which is hereby incorporated by reference in its entirety.

BACKGROUND

Dishwashers typically include a tub defining a washing chamber into which dishes are placed to undergo a washing or treating operation. The dishwasher is generally provided with a closure element and dish racks for supporting items during the washing or treating operation

BRIEF DESCRIPTION

In one aspect, the disclosure relates to a dishwasher having a tub at least partially defining a treating chamber receiving dishes for treatment, a dish rack located in the tub and having a bottom wall and at least a side wall extending upwardly from the bottom wall, the side wall including a set of vertical tines, and a shelf having a planar body extending along a length and operably coupled to the set of vertical tines and rotatable between a stowed position that is substantially vertical and a deployed position that is substantially horizontal. The planar body includes a plurality of guide slots spaced apart from each other along the length. Each guide slot includes an open channel that formed at least in part by a first wall and a second wall, spaced from the first wall. A cross-bar is mounted to the planar body of the shelf and retains at least one vertical tine of the set of vertical tines between the cross-bar and the planar body. A first vertical tine of the set of vertical tines is received within the open channel and the first vertical tine includes a first bend configured to form a first stop such that the shelf can be vertically adjusted to a first height correlating to a height of the first stop.

In another aspect, the disclosure relates to a dishwasher having a tub at least partially defining a treating chamber receiving dishes for treatment, a dish rack located in the tub and having a bottom wall and at least a side wall extending upwardly from the bottom wall the side wall including a set of vertical tines and defining a first side and a second side, and a shelf having a planar body extending along a length and operably coupled to a set of vertical tines and rotatable between a stowed position that is substantially vertical and a deployed position that is substantially horizontal. The body includes at least one guide slot. Each guide slot including an open channel formed at least in part by a first wall and a second wall, spaced from the first wall and joined by a rear wall forming a rear surface. A first vertical tine of the set of vertical tines is received within the open channel and the first vertical tine includes a first bend configured to form a first stop such that the shelf can be vertically adjusted to a first height correlating to a height of the first stop. The first wall and second wall are configured to guide movement of the shelf. The rear surface abuts the vertical tine in a manner configured to allow for vertical movement of the shelf along the set of vertical tines between at least a lower position and an upper position. A cross-bar is mounted to the planar body of the shelf and retains at least one vertical tine of the set of vertical tines between the cross-bar and the planar body.

In another aspect, the disclosure relates to dishrack for a dishwasher having a bottom wall and at least a side wall extending upwardly from the bottom wall, the side wall including a set of vertical tines. A shelf having a planar body extending along a length and operably coupled to the set of vertical tines and rotatable between a stowed position that is substantially vertical and a deployed position that is substantially horizontal. The planar body includes a plurality of guide slots spaced apart from each other along the length. Each guide slot includes an open channel formed at least in part by a first wall and a second wall, spaced from the first wall. A cross-bar is mounted to the planar body of the shelf and retains at least one vertical tine of the set of vertical tines between the cross-bar and the planar body. A first vertical tine of the set of vertical tines is received within the open channel and the first vertical tine includes a first bend configured to form a first stop such that the shelf can be vertically adjusted to a first height correlating to a height of the first stop.

DETAILED DESCRIPTION

Figure 1:
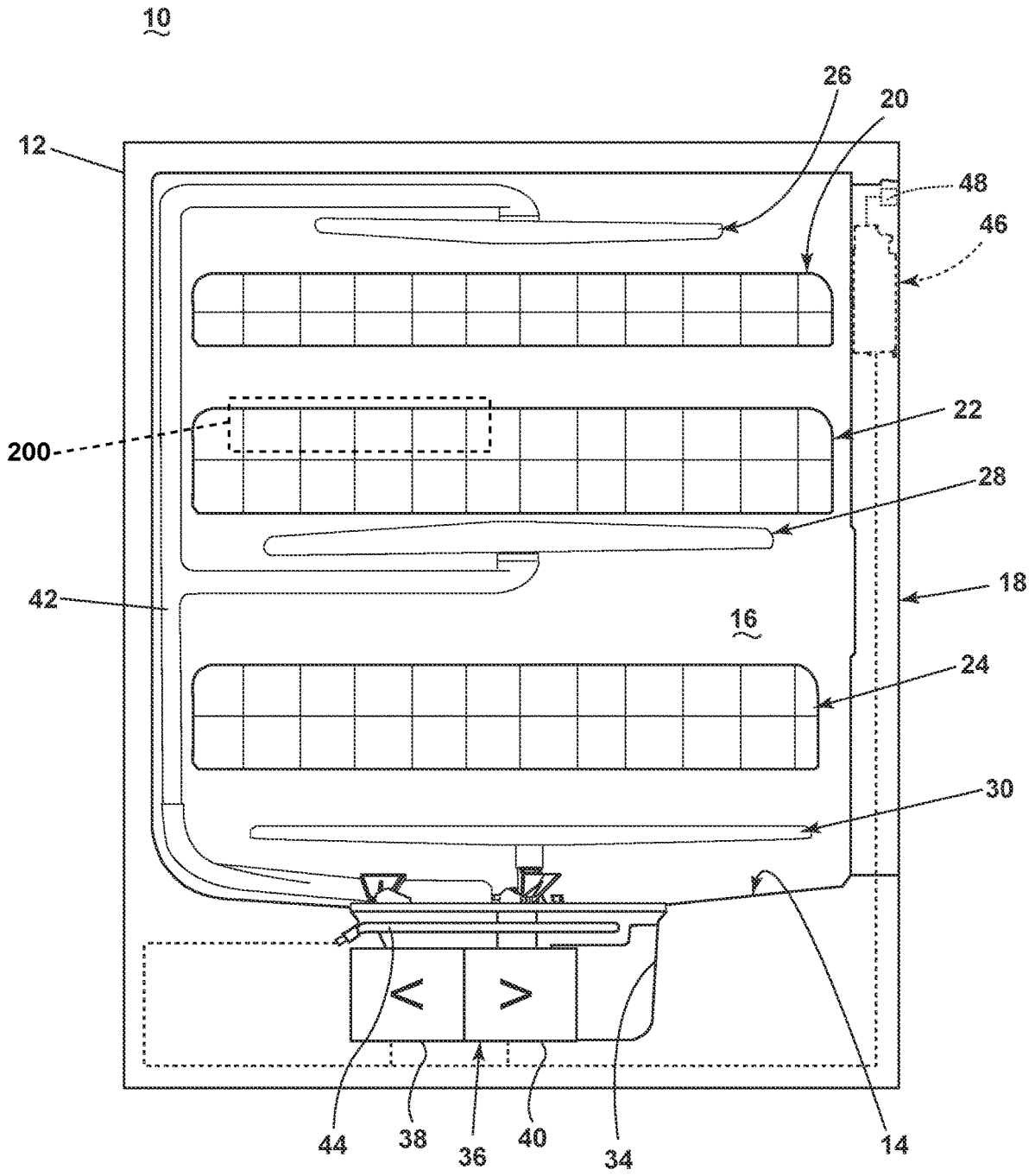
FIG. 1 is a schematic, cross-sectional view of a dishwasher in accordance with various aspects described herein.

In FIG. 1, an automated dishwasher 10 according to an aspect of the present disclosure is illustrated. The dishwasher 10 shares many features of a conventional automated dishwasher, which will not be described in detail herein except as necessary for a complete understanding of the disclosure. A cabinet or chassis 12 can define an interior of the dishwasher 10 and can include a frame, with or without panels mounted to the frame. An open-faced tub 14 can be provided within the chassis 12 and can at least partially define a treating chamber 16, having an open face, for washing dishes. A door assembly 18 can be movably mounted to the dishwasher 10 for movement between opened and closed positions to selectively open and close the open face of the tub 14. Thus, the door assembly provides accessibility to the treating chamber 16 for the loading and unloading of dishes or other washable items.

A closure element, such as the door assembly 18, can be movably mounted to the chassis 12 for movement between opened and closed positions to selectively open and close the treating chamber access opening defined by the open face of the tub 14. Thus, the door assembly 18 provides accessibility to the treating chamber 16 for the loading and unloading of dishes or other washable items. It should be appreciated that the door assembly 18 can be secured to the lower front edge of the chassis 12 or to the lower front edge of the tub 14 via a hinge assembly (not shown) configured to pivot the door assembly 18. When the door assembly 18 is closed, user access to the treating chamber 16 can be prevented, whereas user access to the treating chamber 16 can be permitted when the door assembly 18 is open. Alternatively, the closure element can be slidable relative to the chassis 12, such as in a drawer-type dishwasher, wherein the access opening for the treating chamber 16 is formed by an open-top tub. Other configurations of the closure element relative to the chassis 12 and the tub 14 are also within the scope of the disclosure.

Dish holders, illustrated in the form of upper, middle, and lower dish racks 20, 22, 24, can be located within the treating chamber 16 and receive dishes for treatment, such as washing. The upper, middle, and lower dish racks 20, 22, 24 are typically mounted for slidable movement in and out of the treating chamber 16 for ease of loading and unloading. Other dish holders can be provided, such as a silverware basket, separate from or integral with any of the upper, middle, and lower dish racks 20, 22, 24. As used in this description, the term "dish(es)" is intended to be generic to any item, single or plural, that can be treated in the dishwasher 10, including, without limitation, dishes, plates, pots, bowls, pans, glassware, and silverware. While the dishwasher 10 is illustrated herein as having three dish racks 20, 22, 24, it will be understood that any suitable number and configuration of dish racks is also within the scope of the disclosure.

A spray system is provided for spraying liquid in the treating chamber 16 and can be provided in the form of, for example, an upper spray assembly 26, a middle spray assembly 28, and a lower spray assembly 30. The upper spray assembly 26, the middle spray assembly 28, and the lower spray assembly 30 are located, respectively, above the upper dish rack 20, beneath the middle dish rack 22, and beneath the lower dish rack 24, and are illustrated as rotating spray arms by example but are not limited to such positions and sprayer type. Furthermore, the spray system can include additional and/or alternative spray assemblies. For example, a distribution header or spray manifold can be located at the rear of the tub 14 at any vertical position. An exemplary spray manifold is set forth in detail in U.S. Pat. No. 7,594,513, issued Sep. 29, 2009, and titled "Multiple Wash Zone Dishwasher," which is incorporated herein by reference in its entirety.

A recirculation system can be provided for recirculating liquid from the treating chamber 16 to the spray system. The recirculation system can include a sump 34 and a pump assembly 36. The sump 34 collects the liquid sprayed in the treating chamber 16 and can be formed by a sloped or recess portion of a bottom wall of the tub 14. The pump assembly 36 can include both a drain pump 38 and a recirculation pump 40. The drain pump 38 can draw liquid from the sump 34 and pump the liquid out of the dishwasher 10 to a household drain line (not shown). The recirculation pump 40 can draw liquid from the sump 34, and the liquid can be simultaneously or selectively pumped through a supply conduit or tube 42 to each of the spray assemblies 26, 28, 30 for selective spraying. The liquid supply tube 42 extends along a wall of the tub 14 and fluidly connect the pump assembly 36 to the spray assemblies 26, 28, 30. While not shown, a liquid supply system can include a water supply conduit coupled with a household water supply for supplying water to the treating chamber 16.

A heating system including a heater 44 can be located, for example, within the sump 34 for heating the liquid contained in the sump 34. The heater 44 can also heat air contained in the treating chamber 16. Alternatively, a separate heating element (not shown) can be provided for heating the air circulated through the treating chamber 16. A filtering system (not shown) can be fluidly coupled with the recirculation flow path for filtering the recirculated liquid.

A control system including a controller 46 can also be included in the dishwasher 10, which can be operably coupled with various components of the dishwasher 10 to implement a cycle of operation. The controller 46 can be located within the door assembly 18 as illustrated, or it can alternatively be located somewhere within the chassis 12. The controller 46 can also be operably coupled with a control panel or user interface 48 for receiving user-selected inputs and communicating information to the user. The user interface 48 can include operational controls such as dials, lights, switches, and displays enabling a user to input commands, such as a cycle of operation, to the controller 46 and receive information.

Figure 2:
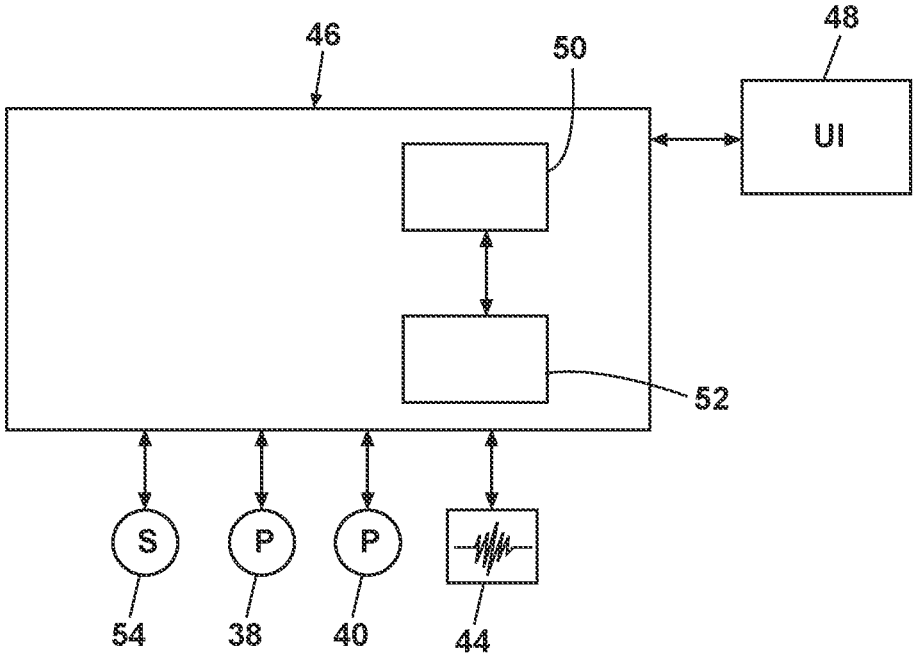
FIG. 2 is a schematic view of a controller of the dishwasher of FIG. 1.

As illustrated schematically in FIG. 2, the controller 46 can be coupled with the heater 44 for heating the wash liquid during a cycle of operation, the drain pump 38 for draining liquid from the treating chamber 16, and the recirculation pump 40 for recirculating the wash liquid during the cycle of operation. The controller 46 can be provided with a memory 50 and a central processing unit (CPU) 52. The memory 50 can be used for storing control software that can be executed by the CPU 52 in completing an automatic cycle of operation using the dishwasher 10 and any additional software. For example, the memory 50 can store one or more pre-programmed cycles of operation that can be selected by a user and completed by the dishwasher 10. A cycle of operation for the dishwasher 10 can include one or more of the following steps: a wash step, a rinse step, and a drying step. The wash step can further include a pre-wash step and a main wash step. The rinse step can also include multiple steps such as one or more additional rinsing steps performed in addition to a first rinsing. The amounts of water and/or rinse aid used during each of the multiple rinse steps can be varied. The drying step can have a non-heated drying step (so called "air only"), a heated drying step, or a combination thereof. These multiple steps can also be performed by the dishwasher 10 in any desired combination.

The controller 46 can also receive input from one or more sensors 54. Non-limiting examples of sensors that can be communicably coupled with the controller 46 include a temperature sensor and turbidity sensor to determine the soil load associated with a selected grouping of dishes, such as the dishes associated with a particular area of the treating chamber 16.

The dishwasher 10 can include all of the above exemplary systems, a selection of the above exemplary systems, and/or other systems not listed above as desired. Further, some of the systems can be combined with other systems and/or can share components with other systems. Examples of other systems that the dishwasher 10 can further include are a dispensing system that supplies one or more treating agents or chemistries to the treating chamber 16 and an air supply system that can provide air, which can be heated or not heated, to the treating chamber 16, such as for drying and/or cooling the dishes. An exemplary air supply system is set forth in U.S. patent application Ser. No. 12/959,673, filed Dec. 3, 2010, and published as U.S. Patent Application Publication No. 2012/0138106 on Jun. 7, 2012, both of which are incorporated herein by reference in their entireties.

Dish rack 22 can optionally include any number of accessory structures permanently fixed or removably provided on the dish rack 22. Accessory structures can be directed toward the accommodation of additional dishes or differently sized items to increase the number of items capable of being loaded into the dish rack 22 for treating. Accessory structures can include, but are not limited to, silverware baskets and/or caddies, utensil racks and/or caddies, shelves, bottle washers, rotatable tines and/or nozzles, removable dish rack inserts, and other baskets for silverware, utensils, and/or small items. In traditional dishwashers, these accessory structures can occupy valuable space in the dish rack that would be otherwise available for receiving dishes. In addition, the location of these accessory structures in a dish rack can interfere with the ability to move an upper dish rack in and out of a dishwasher without contacting an accessory structure provided in a lower dish rack.

Figure 3:
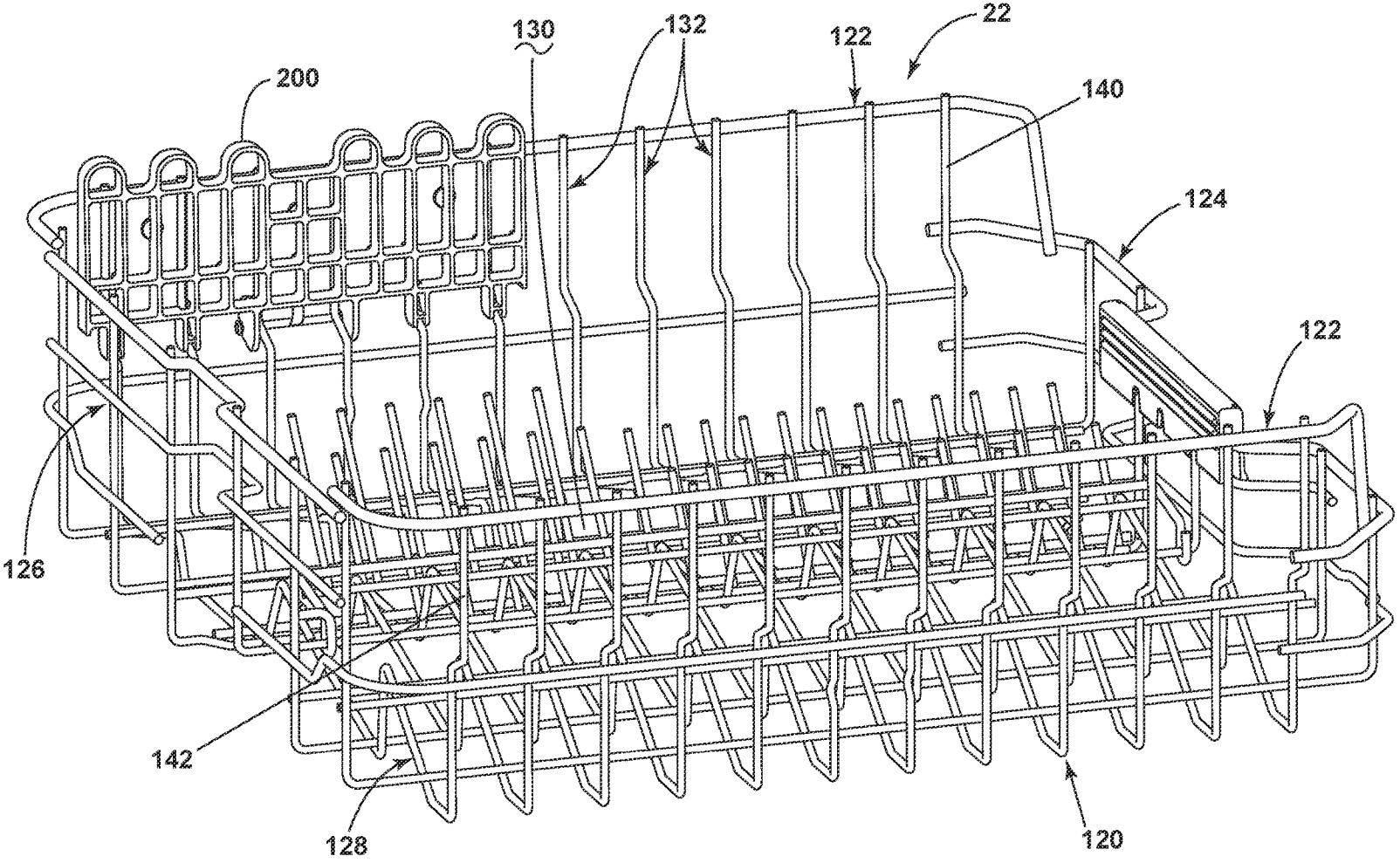
FIG. 3 is a perspective view of a dish rack and shelf of the dishwasher of FIG. 1.

Aspects of the present disclosure relate to one or more shelves for supporting items to be cleaned. Such shelves can be included in the dish holders or dish racks of the dishwasher 10. By way of non-limiting example, a shelf 200 can be included in any of the dish racks and has been illustrated within dish rack 22. The shelf 200 can be configured to pivot between a horizontal position (FIG. 5) where it can more easily support dishes and a vertical position where it can be stored. Aspects of the present disclosure include, among other things, a shelf that is simple and easy to operate, has reduced cost and part counts, and does not interfere with other dish racks. Further, while the figures illustrate a front-loading dishwasher, it will be understood that aspects of the disclosure can alternately be utilized within drawer type dishwashers. In the case of dishwashers utilizing multiple dish racks FIG. 3 illustrates an exemplary dish rack 22 having a shelf 200 according to an aspect of the present disclosure. It will be understood that the described structure and features of the dish rack 22 are suitable for use in any or all dish racks 20, 22, 24. The dish rack 22 can be constructed of a wire frame 120 forming opposing side walls 122, front wall 124, rear wall 126, and a bottom wall 128 that together define an open-top holding compartment or interior 130 with the side walls 122, front wall 124, and rear wall 126 extending upwardly from the bottom wall 128. The side walls 122, front wall 124, and/or rear wall 126 can include a set of vertical tines 132. The set of vertical tines 132 can comprise a first side 140 facing the interior 130 and defining an interior side of the dish rack 22, and a second side 142 generally opposite the first side 140 and defining an exterior side of the dish rack 22. The bottom wall 128 can have a constant profile or can have a varied profile comprising any combination of inclined, curved, or flat sections or plurality of sections. The varied profile can be utilized to support various dishes. Additionally or alternatively, a plurality of supports such as panels, tines, or other structures, can extend upwardly from the bottom wall 128, the side walls 122, the front wall 124, or the rear wall 126 to support various dish items. While the dish rack 22 is illustrated as constructed of coated wire, the dish rack 22 can be constructed of other suitable materials including, but not limited to, uncoated wire, thermoformed plastic, or metal.

Figure 5:
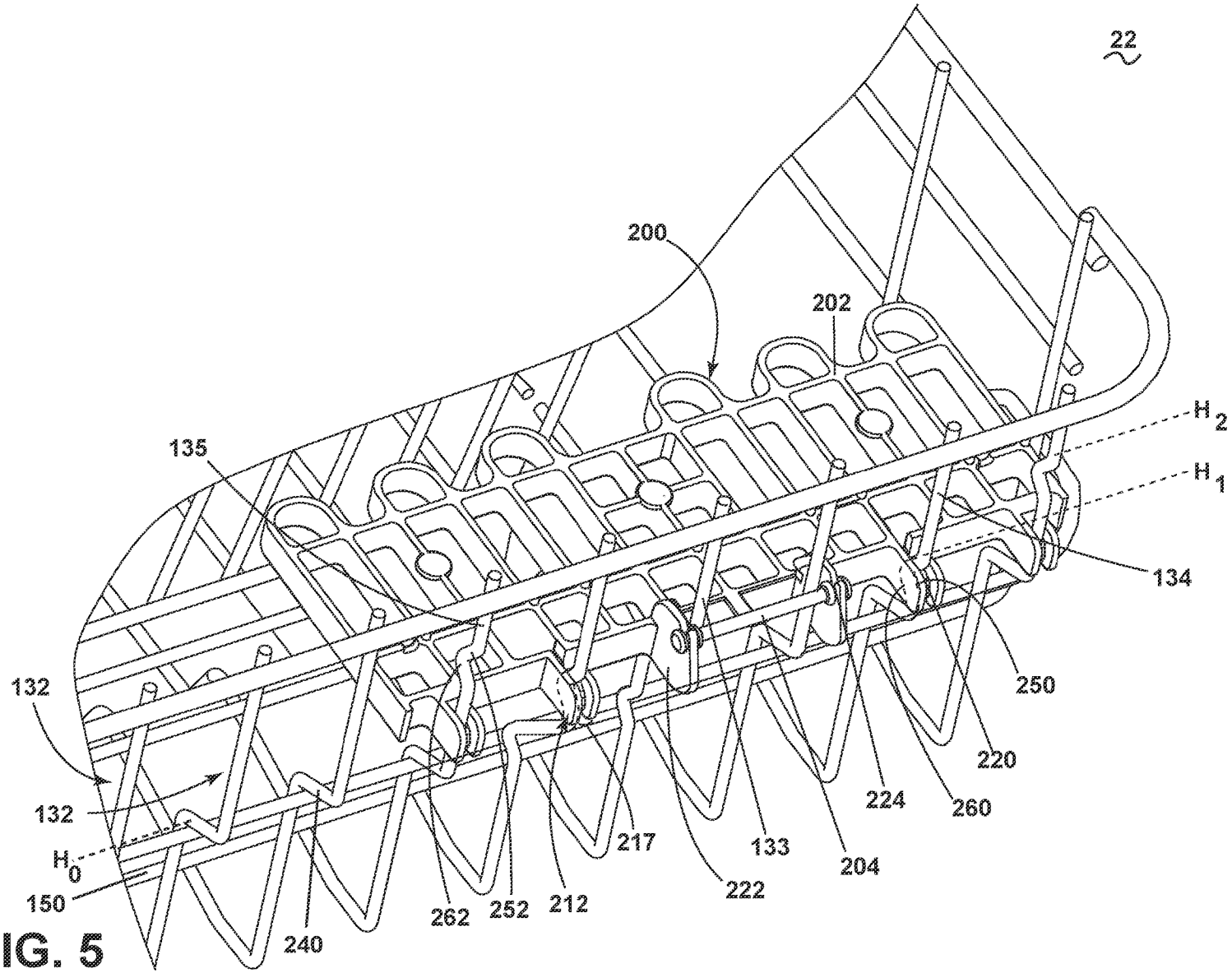
FIG. 5 is a perspective view of a portion of the dish rack and the shelf of FIG. 3 in a first position according to aspects of the present disclosure.

The shelf 200 can be provided generally within the interior 130 and can extend along at least a portion of a length of one of the walls forming the dish rack 22. In the illustrated example, the shelf 200 is illustrated as extending along approximately half of the side wall 122. The shelf 200 is operably coupled to the set of vertical tines 132 and is capable of pivoting or rotating between an upright or stowed position, as illustrated, and one or more deployed positions that can be more laid-down than the stowed position, including a substantially horizontal position (FIG. 5). As used herein, a "substantially horizontal position" refers to a position of the shelf 200 that is more horizontal than the upright position such that items placed on the shelf 200 will not be dislodged by gravity or by a spraying liquid. Further still, the shelf 200 can be operably coupled with the set of vertical tines 132 in such a manner that the shelf 200 can be vertically adjusted between one or more vertical positions. The shelf 200 can be rotated between its upright position and the one or more deployed position.

In another aspect, the dish rack 22 can include two or more shelves 200 provided along the length of the side wall 122 in succession. The two or more shelves 200 can be operated independently of each other. Further still, the shelf 200 can be included on multiple opposing side walls 122, front wall 124, or rear wall 126.

Figure 4:
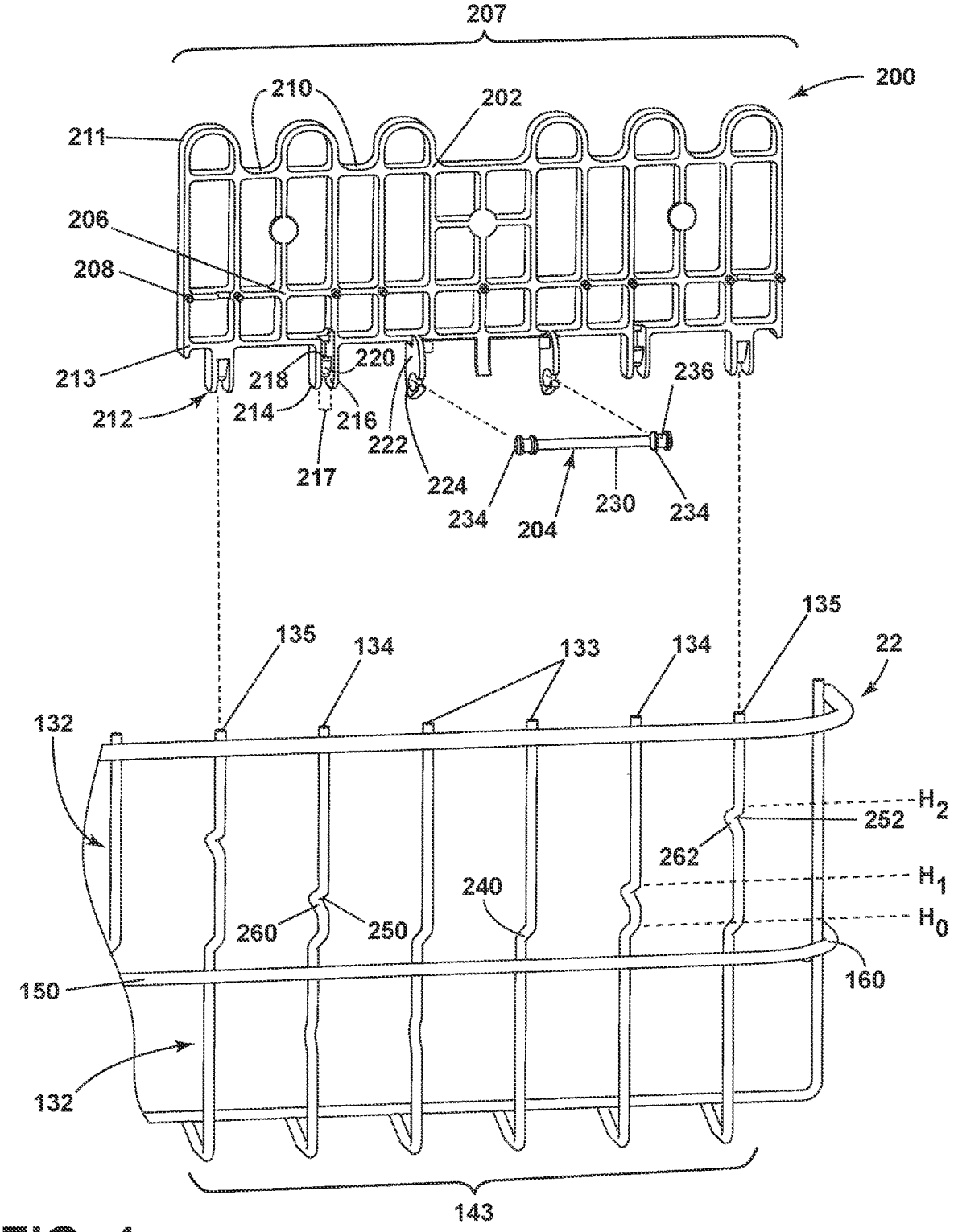
FIG. 4 is an exploded rear view of a portion of the dish rack and the shelf of FIG. 3.

FIG. 4 illustrates an exploded rear view of the shelf 200 and a portion of the dish rack 22. A planar body 202 of the shelf 200 can extend along a length 143 of the set of vertical tines 132, and at least one cross-bar 204 is configured to mount to the planar body 202 after the planar body 202 is placed adjacent the dish rack 22. The planar body 202 generally comprises a frame 206, spanning a length 207 of the planar body 202, which can, by way of non-limiting example, form a grid-like pattern configured to support small dishes to be treated and configured to allow liquid to pass through the frame 206 during a treating cycle. A set of spaced protrusions 208 can extend upwardly from a portion of the frame 206 when the shelf 200 is in the deployed position to support or retain various dishes. A set of spaced apart U-shaped elements 210 can also be included along the length 207 forming a first end 211 of the frame 206 such that when the shelf 200 is deployed, each U-shaped element 210 can accommodate and retain small items such as, but not limited to, stemmed glassware, bottle tops, or small kitchen utensils.

One or more guide slots 212 can be operably coupled or integrally formed with the planar body 202. In the case where multiple guide slots 212 are included, as illustrated, the guide slots 212 are in a spaced apart relationship along a second end 213 of the frame 206 that is parallel to the first end 211. A first wall 214 and a second wall 216 at least partially form an open channel 217 for each guide slot 212. The first wall 214 can be spaced from and joined to the second wall 216 by a rear wall 218 forming a rear surface 220. The open channel 217 can receive at least one of the vertical tines in the set of vertical tines 132. That is one of the set of vertical tines 132 can be located between the first wall 214 and the second wall 216. In this manner, the first wall 214 and the second wall 216 can guide vertical movement of the shelf 200 along the vertical tine of the set of vertical tines 132 within the open channel 217 and prevent lateral movement of the shelf 200. The rear surface 220 can include a shape, profile, or contour to aid in movement of the shelf 200. By way of non-limiting, the rear surface 220 can include a curved profile. The one or more guide slots 212 can be shaped in any suitable manner to guide rotatable and vertical movement of the shelf 200.

One or more pair of spaced walls 222 can be provided on the second end 213 of the frame 206 on the length 207 of the planar body 202. Each spaced wall 222 is illustrated as including an aperture 224, which can be in the form of a slot, gap, opening, or slit configured to receive the cross-bar 204. By illustrated example, the aperture 224 is in the form of a C-shaped slot formed in each of the spaced walls 222. It will be understood that the shelf 200 can have any suitable shape and profile and can be formed of any suitable material. While the shelf 200 is illustrated as a thermoformed plastic, the shelf 200 can be constructed of one or more other suitable materials including, but not limited to, coated or uncoated wire, or a metal such as stainless steel.

An elongate body 230 and one or more retaining members 234 provided at one or both distal end regions of the elongate body 230 can be included in the cross-bar 204. In the illustrated example, the cross-bar 204 comprises a cylindrical shape. As illustrated in FIG. 4, a pair of spaced retaining members 234 can be provided on each of the distal ends of the elongate body 230 forming a coupling space 236 that is snap-fit and retained in the seat of the C-shaped slot 224 to prevent lateral movement of the cross-bar 204 out of the C-shaped slots 224. Alternatively, a single retaining member 234 can be provided at one or both distal ends or end regions of the elongate body 230. The cross-bar 204 can be form in any suitable manner such that it can be received and retained in the aperture 224. By way of non-limiting example, the aperture 224 and cross-bar 204 can be correspondingly formed such that the cross-bar is snap-fit into the C-shaped slot 224 and can rotate while retained in the C-shaped slot 224.

The dish rack 22 can further comprise stops correlating to varying vertical heights at which the shelf 200 can be adjusted. Once at the desired vertical height, the shelf 200 can be pivoted to the upright position or deployed position. In an aspect of the present disclosure, the set of vertical tines 132, along the sidewall 122 along which the shelf 200 is located, include one or more of a vertical tine 133, 134, and/or 135. The one or more vertical tines 133 can extend vertically from the bottom wall 128 or from a horizontal portion 150 generally located at the midline of the side wall 122 of the dish rack 22. The one or more vertical tines 133 can include a first bend 240 vertically spaced from the horizontal portion 150. The horizontal portion 150 can forms a first stop 160 configured to engage the cross-bar 204 or the spaced walls 222 such that the shelf 200 can be vertically adjusted to an initial height $H_0$ correlating with the vertical height location of the first bend 240. The one or more vertical tines 134 can be similar in structure to the vertical tines 133 and can further include a second bend 250, vertically spaced from the first bend 240, forming a second stop 260 where the second stop 260 is configured to engage the rear surface 220 of the guide slot 212 such that the shelf 200 can be vertically adjusted to a first height $H_1$ correlating with the vertical height location of the second stop 260. The set of vertical tines 132 can further include one or more vertical tines 135 having third bend 252, vertically spaced from the second bend 250, forming a third stop 262 where the third stop 262 engages the rear surface 220 of the guide slot 212 such that the shelf 200 can be vertically adjusted to a second height $H_2$ correlating with the vertical height location of the third stop 262. Each set of vertical tines 132 can include multiple vertical tines 133, 134 and 135 in a sequential or substantially alternating pattern. It is further contemplated that one or more vertical tines in the set of vertical tines 132 can include any combination of the first bend 240, the second bend 250, and the third bend 252.

FIG. 5 illustrates a portion of the dish rack 22 with the shelf 200 in a horizontal deployed position. As assembled, the planar body 202 is provided on the interior of the dish rack 22 and can engage the first side 140 of the set of vertical tines 132, and the cross-bar 204 is provided exterior to the dish rack 22 and engages the second side 142 of the set of vertical tines 132 such that the cross-bar 204 retains one or more of the set of vertical tines 132, between the cross-bar 204 and the planar body 202. Regardless of the rotational position of the planar body 202, the rear surfaces 220 of the guide slots 212 are biased against and engaged with the first side 140 of the vertical tines 134 at the vertical height of the second stop 260 while the cross-bar 204 is biased against the second side 142 of the vertical tines 133 retained between the cross-bar 204 and the planar body 202. In the illustrated example, two vertical tines 133 are retained between the cross-bar 204 and the planar body 202. The two vertical tines 133 are additionally laterally retained between the spaced walls 222 of the planar body 202.

Further still, the guide slots 212 each retain one of the set of vertical tines 132 including both vertical tines 134 and vertical tines 135. The set of vertical tines 132 is received in the open channel 217 such that the rear surface 220 of the guide slot 212 is configured to abut the first side 140 of the vertical tine 134, 135. The guide slots 212 are engaged with the second vertical stops 260 such that the planar body 202 is at the first height $H_1$. The shelf 200 is biased by the second stop 260 in the deployed position at the first vertical height $H_1$ until an upward or downward force is applied to the planar body 202 to release the biases of the rear surfaces 220 of the guide slots 212 engaged with the second stop 260 and the cross-bar 204 engaged with the vertical tines 133.

To adjust the height of the shelf 200, a user can apply an upward or downward force to the planar body 202. The first wall 214 and the second wall 216 of the guide slots 212 guide the vertical movement of the shelf 200 along each one of the set of vertical tines 132 received in the open channels 217 and the shelf 200 can then be adjusted upward or downward to the one or more of the vertical heights $H_0$, $H_1$, and $H_2$.

Figure 6:
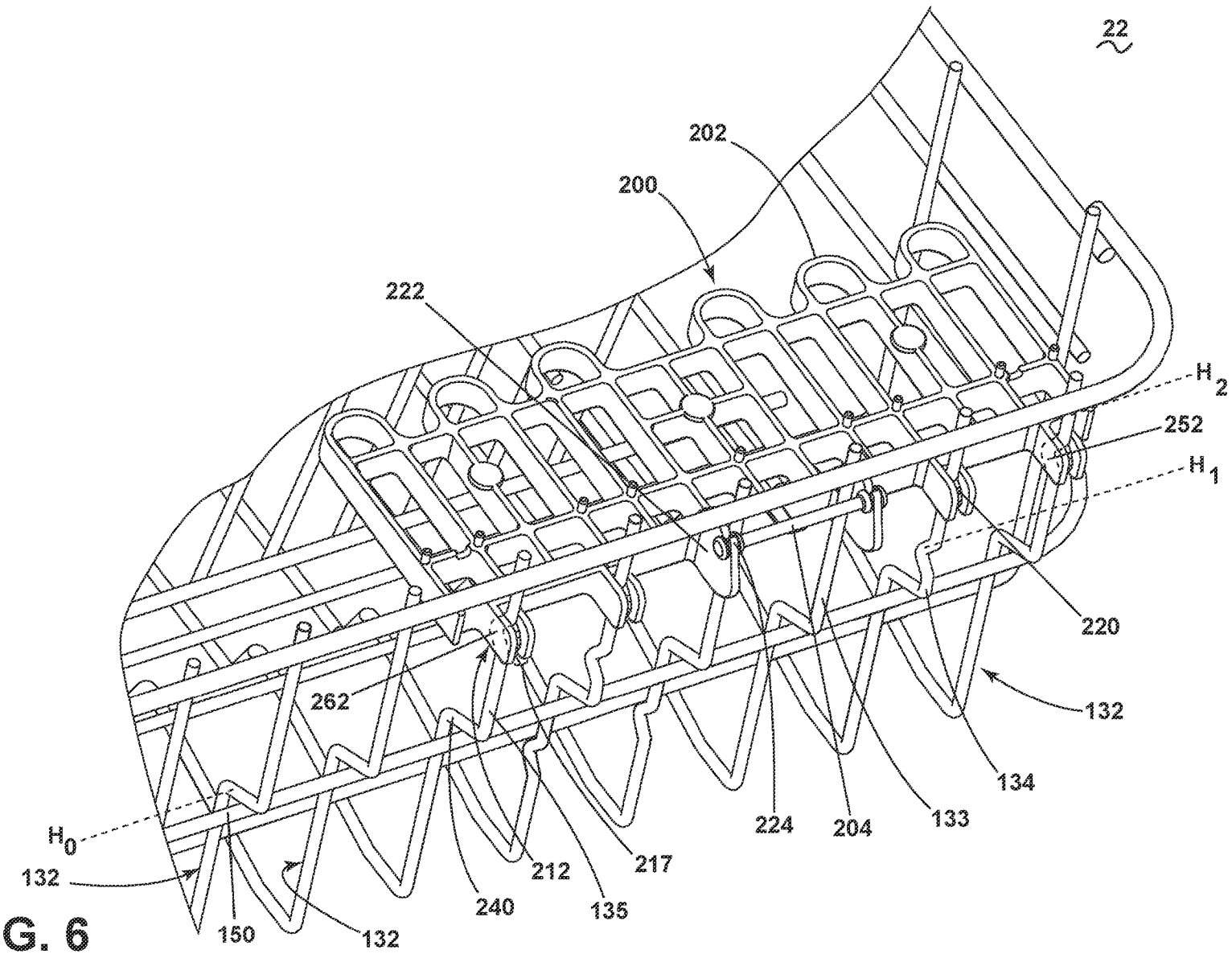
FIG. 6 is a perspective view of a portion of the dish rack and the shelf of FIG. 3 in a secondary position according to aspects of the present disclosure.

FIG. 6 illustrates a portion of the dish rack 22 with the shelf 200 in the deployed position at the second height $H_2$, which correlates with the height of the third stop 262. In such a vertical position, the guide slots 212 align with the third stop 262 of the vertical tines 135. During vertical movement of the shelf 200, the first wall 214 and the second wall 216 guide movement of the shelf 200 along the vertical tine 134, 135 within the open channel 217 and prevent lateral movement of the shelf 200. The rear surface 220 can include a shape, profile, or contour to aid in movement of the shelf 200. By way of non-limiting, the rear surface 220 can include a curved profile that aides in guiding or enabling vertical movement of the shelf 200 along the vertical tines 133, 134, 135 when the shelf 200 is in the stowed position and can abut the vertical tine 133, 134, 135 to enable the shelf 200 to adjust between one or more vertical positions.

To pivot or rotate the planar body 202, a user can pivot the planar body 202 about the axis of cross-bar 204. For example, when pivoting to a stowed position, as the planar body 202 pivots toward a substantially upright and vertical position, the rear surfaces 220 of the guide slots 212 release the bias with the bends 240, 250, or 260 in the vertical tines 134 and 135, while the cross-bar 204 releases the bias with the vertical tines 133 such that the cross-bar can rotate in the C-shaped slots 224. Regardless of the rotational position of the planar body 202, the rear surfaces 220 of the guide slots 212 can remain engaged or abutted to the first side 140 of the vertical tines 134, 135, while the cross-bar can remain engaged or abutted to the second side 142 of the vertical tines 133. The guide slots 212 can interface with the vertical tines 134 and 135 such that the shelf 200 can be retained in the stowed position. Further, the weight of the shelf 200 aides in keeping the shelf 200 in the stowed position and from moving without user assistance. The shelf 200 can be vertically adjusted when in the stowed position. Once the shelf 200 is in the upright stowed position, the first wall 214 and second wall 216 of the guide slots 212 can guide the vertical movement of the shelf 200 along the set of vertical tines 132 received in the open channels 217 and the shelf 200 can be adjusted upward or downward while in the upright stowed position.

By further example, when pivoting to a deployed position, as the planar body 202 pivots toward a substantially horizontal position, the rear surfaces 220 of the guide slots 212 bias against the first side 140 of the vertical tines 134, 135, while the cross-bar 204 biases against the second side 142 of the vertical tines 133 retained between the cross-bar 204 and the planar body 202. The shelf 200 can be vertically adjusted when in the deployed position.

Alternatively, it is contemplated that when the shelf 200 is deployed, the biases of the rear surfaces 220 of the guide slots 212 against the vertical tines 133, 134, 134 can prevent vertical adjustment of the shelf 200 and lock the shelf 200 in a vertical, deployed position until the planar body 202 is pivoted upward.

When the shelf 200 is in the one or more deployed positions, the shelf 200 can support dishes to be washed such as, but not limited to, cups, mugs, bowls, utensils, bottles, and lids, on an upward facing side, and to support dish items such as stemware, bottle tops along the first end 211. Additionally, the shelf 200 can help prevent items provided in the dish rack from ejecting from the dish rack 22 during a cycle on a lower side that faces the interior 130 of the dish rack 22.

In a traditional dishwasher, complex shelf assemblies can be a significant contributor to space constraints in a dishwasher and a dish rack. The presence of shelf assemblies can create a large profile when in the stowed and upright position, consuming valuable treating chamber space. Additionally, when in the stowed position, the presence of a shelf assembly often limits the ability to stow the shelf low enough with respect to the uppermost edge of the dish rack above, so that an upper dish rack does not move in and out of the dishwasher tub freely without contacting the stowed shelf located in the dish rack below.

Aspects of the present disclosure remove the need for a complex shelf assembly on which to vertically adjust the shelf by incorporating structural modifications to the vertical dish rack tines to provide vertical adjustability to a shelf and simplify the design. Removal of the complex shelf assembly provides increased usable space in a dish rack with a shelf when the shelf is deployed or stowed. Additionally, aspects of the present disclosure stow the shelf at a lower vertical position to avoid interfering with the movement of an upper dish rack.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dishwasher, comprising:

a tub at least partially defining a treating chamber receiving dishes for treatment;

a dish rack located in the tub and having a bottom wall and at least a side wall extending upwardly from the bottom wall, the side wall including a set of vertical tines; and a shelf having a planar body extending along a length and operably coupled to the set of vertical tines and rotatable between a stowed position that is substantially vertical and a deployed position that is substantially horizontal and wherein the planar body includes a plurality of guide slots spaced apart from each other along the length, wherein a first guide slot from the plurality of guide slots includes a first open channel formed at least in part by a first wall and a second wall, spaced from the first wall;

a cross-bar mounted to the planar body of the shelf and retaining at least two vertical tines of the set of vertical tines between the cross-bar and the planar body; and wherein a first vertical tine of the set of vertical tines is received within the first open channel and wherein the first vertical tine includes a first bend configured to form a first stop such that the shelf can be vertically adjusted to a first height correlating to a height of the first stop.

2. The dishwasher of claim 1, wherein the plurality of guide slots retains vertical tines of the set of vertical tines that are other than the at least two vertical tines from the set of vertical tines that are retained by the cross-bar.

3. The dishwasher of claim 2, wherein the first wall and the second wall of the first guide slot are configured to guide movement of the shelf along the first vertical tine within the first open channel.

4. The dishwasher of claim 1, wherein the plurality of guide slots retains vertical tines of the set of vertical tines that are other than the at least two vertical tines from the set of vertical tines that are retained by the cross-bar, from a first side of the first vertical tine.

5. The dishwasher of claim 4, wherein the cross-bar engages the at least two vertical tines at a second side opposite the first side.

6. The dishwasher of claim 1, wherein the first guide slot comprises a rear wall forming a rear surface.

7. The dishwasher of claim 6, wherein the rear surface of the first guide slot engages the first bend to hold the shelf at the first height.

8. The dishwasher of claim 1 wherein the first vertical tine received further includes a second bend vertically spaced from the first bend and configured to form a second stop that engages a rear surface of the first guide slot such that the shelf can be vertically adjusted to a second height correlating to a height of the second stop.

9. The dishwasher of claim 1 wherein a second vertical tine received within a second guide slot from the plurality of guide slots includes a second bend vertically spaced from the first bend and configured to form a second stop that engages a rear surface of the second guide slot such that the shelf can be vertically adjusted to a second height correlating to a height of the second stop.

10. The dishwasher of claim 9 wherein there are multiple vertical tines having first bends at the first height and multiple vertical tines having second bends at the second height.

11. A dishwasher, comprising:

a tub at least partially defining a treating chamber receiving dishes for treatment;

a dish rack located in the tub and having a bottom wall and at least a side wall extending upwardly from the bottom wall, the side wall including a set of vertical tines;

a shelf having a planar body extending along a length and operably coupled to at least some tines of the set of vertical tines and rotatable between a stowed position that is substantially vertical and a deployed position that is substantially horizontal wherein the body includes at least one guide slot, each guide slot including an open channel formed at least in part by a first wall and a second wall, spaced from the first wall and joined by a rear wall forming a rear surface and wherein a first vertical tine of the set of vertical tines is received within the open channel and wherein the first vertical tine includes a first bend configured to form a first stop such that the shelf can be vertically adjusted to a first height correlating to a height of the first stop and wherein the first wall and second wall are configured to guide movement of the shelf and the rear surface abuts the first vertical tine in a manner configured to allow for vertical movement of the shelf along the set of vertical tines between at least a lower position and an upper position; and a cross-bar mounted to the planar body of the shelf and retaining multiple vertical tines of the set of vertical tines between the cross-bar and the planar body.

12. The dishwasher of claim 11 wherein the first vertical tine received further includes a second bend vertically spaced from the first bend and configured to form a second stop that engages the rear surface of the at least one guide slot such that the shelf can be vertically adjusted to a second height correlating to a height of the second stop.

13. The dishwasher of claim 12 wherein the at least one guide slot includes a first guide slot receiving the first vertical tine, and a second guide slot, wherein a second vertical tine received within the second guide slot of the set of guide slots includes a second bend vertically spaced from the first bend and configured to form a second stop that engages a rear surface of the second guide slot such that the shelf can be vertically adjusted to a second height correlating to a height of the second stop.

14. The dishwasher of claim 11 wherein the planar body includes spaced walls that the cross-bar is mounted to and wherein at least one vertical tine of the set of vertical tines is received between the spaced walls.

15. A dish rack for dishwasher, comprising:

a bottom wall and at least a side wall extending upwardly from the bottom wall, the side wall including a set of vertical tines;

a shelf having a planar body extending along a length and operably coupled to the set of vertical tines and rotatable between a stowed position that is substantially vertical and a deployed position that is substantially horizontal and wherein the planar body includes a plurality of guide slots spaced apart from each other along the length, wherein a first guide slot from the plurality of guide slots includes a first open channel formed at least in part by a first wall and a second wall, spaced from the first wall;

a cross-bar mounted to the planar body of the shelf and retaining at least two vertical tines of the set of vertical tines between the cross-bar and the planar body; and wherein a first vertical tine of the set of vertical tines is received within the first open channel and wherein the first vertical tine includes a first bend configured to form a first stop such that the shelf can be vertically adjusted to a first height correlating to a height of the first stop.

16. The dish rack of claim 15 wherein the first vertical tine received further includes a second bend vertically spaced from the first bend and configured to form a second stop that engages a rear surface of the first guide slot such that the shelf can be vertically adjusted to a second height correlating to a height of the second stop.

17. The dish rack of claim 16 wherein a second vertical tine received within a second guide slot from the plurality of guide slots includes a second bend vertically spaced from the first bend and configured to form a second stop that engages a rear surface of the second guide slot such that the shelf can be vertically adjusted to a second height correlating to a height of the second stop.

18. The dish rack of claim 17 wherein there are multiple vertical tines having first bends at the first height and multiple vertical tines having second bends at the second height.

* * * * *